US010800188B2

(12) United States Patent
Asada et al.

(10) Patent No.: US 10,800,188 B2
(45) Date of Patent: Oct. 13, 2020

(54) SHEET CORRECTING DEVICE AND PRINTER

(71) Applicants: Kohki Asada, Tokyo (JP); Genichiroh Kawamichi, Kanagawa (JP); Hiroki Ishihara, Kanagawa (JP); Satoshi Aizawa, Ibaraki (JP)

(72) Inventors: Kohki Asada, Tokyo (JP); Genichiroh Kawamichi, Kanagawa (JP); Hiroki Ishihara, Kanagawa (JP); Satoshi Aizawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 17 days.

(21) Appl. No.: 16/154,777

(22) Filed: Oct. 9, 2018

(65) Prior Publication Data

US 2019/0202215 A1 Jul. 4, 2019

(30) Foreign Application Priority Data

Dec. 28, 2017 (JP) ..... 2017-254687
Aug. 24, 2018 (JP) ..... 2018-157550

(51) Int. Cl.
*B41J 11/00* (2006.01)

(52) U.S. Cl.
CPC ..... *B41J 11/002* (2013.01); *B41J 11/0005* (2013.01); *B41J 11/007* (2013.01)

(58) Field of Classification Search
CPC ..... B41J 11/002; B41J 11/007; B41J 11/0015; B41J 11/0005
See application file for complete search history.

(56) References Cited

U.S. PATENT DOCUMENTS

| | | | | |
|---|---|---|---|---|
| 9,365,052 | B1 * | 6/2016 | Moore | G03G 15/755 |
| 2014/0232797 | A1 | 8/2014 | Onodera et al. | |
| 2016/0101635 | A1 | 4/2016 | Hoshino et al. | |
| 2017/0157951 | A1 | 6/2017 | Onodera | |
| 2017/0173974 | A1 | 6/2017 | Hoshino et al. | |
| 2017/0266990 | A1 | 9/2017 | Yoshinuma et al. | |
| 2017/0266991 | A1 | 9/2017 | Onodera et al. | |
| 2017/0334217 | A1 | 11/2017 | Yoshinuma et al. | |
| 2018/0009237 | A1 | 1/2018 | Sakamoto et al. | |
| 2018/0141348 | A1 | 5/2018 | Hoshino et al. | |

(Continued)

FOREIGN PATENT DOCUMENTS

| | | |
|---|---|---|
| JP | 7-036327 | 2/1995 |
| JP | 10-031396 | 2/1998 |

(Continued)

*Primary Examiner* — Geoffrey S Mruk
(74) *Attorney, Agent, or Firm* — Oblon, McClelland, Maier & Neustadt, L.L.P.

(57) ABSTRACT

A sheet correcting device includes a belt pair to sandwich a sheet with an upper belt and a lower belt to convey the sheet in a sheet conveyance direction, a plurality of curved surface members disposed along the sheet conveyance direction, each of the plurality of curved surface members comprising a curved surface to contact the belt pair where the belt pair sandwiches the sheet, a plurality of pressing members facing the curved surface of each of the plurality of curved surface members, respectively, to press the belt pair against the curved surface of each of the plurality of curved surface members, and a heater to heat the sheet via at least one of the upper belt and the lower belt of the belt pair.

19 Claims, 9 Drawing Sheets

(56) References Cited

U.S. PATENT DOCUMENTS

| | | | |
|---|---|---|---|
| 2018/0264803 | A1 | 9/2018 | Hoshino et al. |
| 2018/0264848 | A1 | 9/2018 | Nagasawa et al. |
| 2018/0264849 | A1 | 9/2018 | Kitaoka et al. |

FOREIGN PATENT DOCUMENTS

| | | | | |
|---|---|---|---|---|
| JP | 11-073071 | | 3/1999 | |
| JP | 11073071 | A * | 3/1999 | ..... G03G 201/00 |
| JP | 2008-265987 | | 11/2008 | |
| JP | 2010-167592 | | 8/2010 | |
| JP | 2014-184711 | | 10/2014 | |
| JP | 2016-107519 | | 6/2016 | |
| JP | 2018-012323 | | 1/2018 | |
| JP | 2018-066552 | | 4/2018 | |

* cited by examiner

SHEET CORRECTING DEVICE AND PRINTER

CROSS-REFERENCE TO RELATED APPLICATIONS

This patent application is based on and claims priority pursuant to 35 U.S.C. § 119(a) to Japanese Patent Application No. 2017-254687, filed on Dec. 28, 2017, and Japanese Patent Application No. 2018-157550, filed on Aug. 24, 2018, in the Japan Patent Office, the entire disclosure of each of which is hereby incorporated by reference herein.

BACKGROUND

Technical Field

Aspects of the present disclosure relate to a sheet correcting device and a printer incorporating the sheet correcting device.

Related Art

When a liquid is applied to a sheet such as paper, a deformation of the sheet of paper called cockling (waving) or the like occurs due to localized swelling of the sheet to which the liquid is applied.

A drying apparatus is known that promotes drying of a liquid while suppressing cockling by conveying a continuous roll of paper in contact with a contact member having a predetermined curvature.

Further, a device is known in which a sheet is held between two endless belts and the device winds the sheet around a plurality of rollers to correct curl of the sheet.

SUMMARY

In an aspect of this disclosure, a novel sheet correcting device includes a belt pair including a first belt and a second belt to sandwich a sheet between the first belt and a second belt to convey the sheet in a sheet conveyance direction, a plurality of curved surface members disposed along the sheet conveyance direction, each of the plurality of curved surface members comprising a curved surface to contact the belt pair in an area in which the belt pair sandwiches the sheet, a plurality of sets of pressing members, each of the plurality of sets of pressing members facing the curved surface of each of the plurality of curved surface members to press the belt pair against the curved surface of each of the plurality of curved surface members, and a heater to heat the sheet via at least one of the first belt and the second belt of the belt pair. Each of the plurality of sets of pressing members includes a first pressing member to press the belt pair against the curved surface, and a second pressing member disposed downstream of the first pressing member in the sheet conveyance direction to press the belt pair against the curved surface facing the first pressing member, and the first pressing member is spaced away from the second pressing member.

In another aspect of this disclosure, a novel printer includes a liquid application device to apply liquid to a sheet and the sheet correcting device as described above. The sheet correcting device is disposed downstream of the liquid application device in the sheet conveyance direction.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
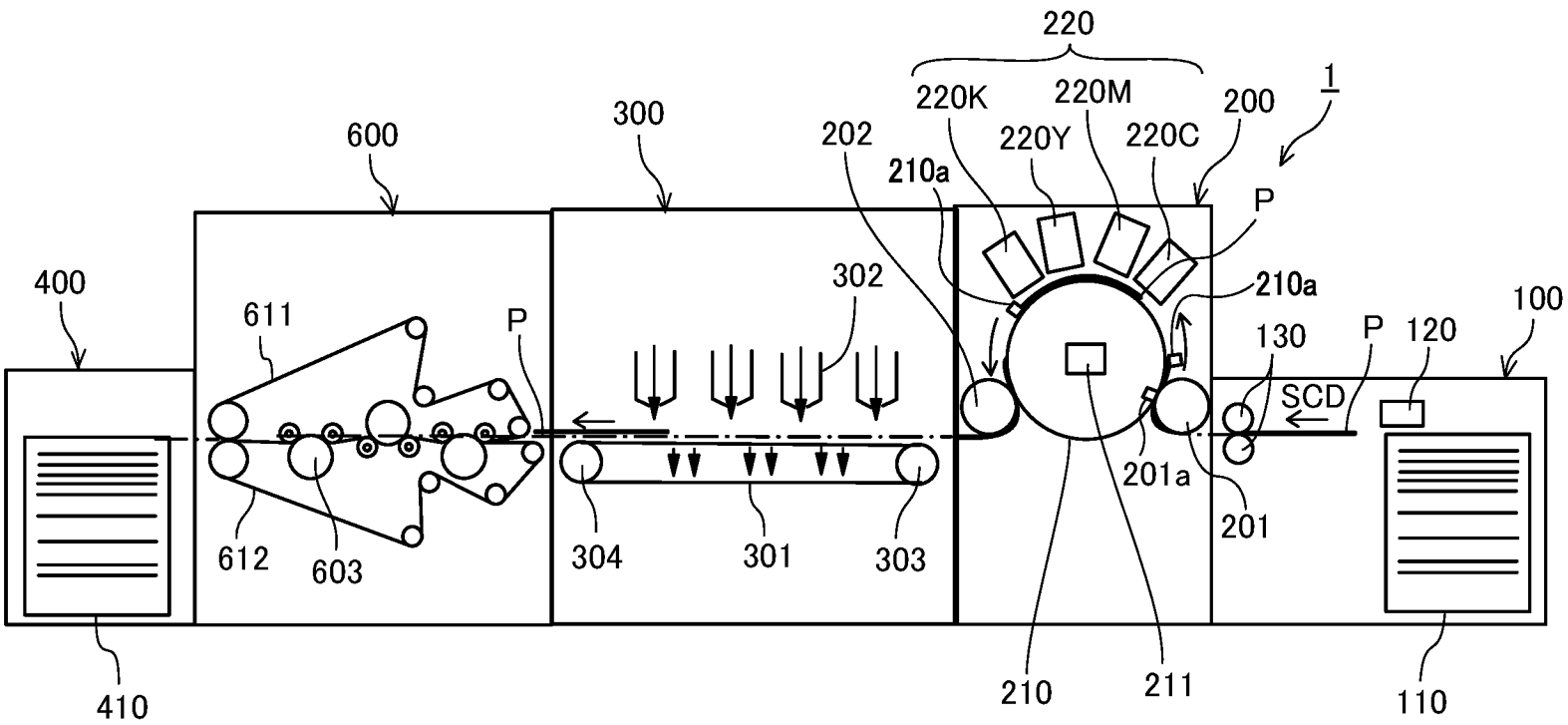
FIG. 1 is a schematic view of the printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural faints as well, unless the context clearly indicates otherwise.

Referring now to the drawings, wherein like reference numerals designate identical or corresponding parts throughout the several views, exemplary embodiments of the present disclosure are described below.

First, a printer according to a first embodiment of the present disclosure is described with reference to FIG. 1. FIG. 1 is a schematic view of the printer according to the first embodiment.

The printer 1 includes a loading device 100, a printing device 200, a drying device 300, a sheet correcting apparatus 600 including a sheet correcting device according to the present embodiment, and an ejection device 400. The printer 1 applies a liquid to a sheet P conveyed from the loading device 100 by the printing device 200 to perform required printing, dries the liquid adhering to the sheet P by the drying device 300, performs a sheet correction process on the sheet P, in which deformation such as cockling has occurred, by the sheet correcting apparatus 600, and ejects the sheet P to the ejection device 400.

The loading device 100 includes a loading tray 110 on which a plurality of sheets P is stacked, a feeding device 120 to separate and feed the sheets P one by one from the loading tray 110, and a registration roller pair 130 to feed the sheet P to the printing device 200.

As the feeding device 120, any feeding device, such as a device using rollers or a device using air suction, can be used. The sheet P delivered from the loading tray 110 by the feeding device 120 is delivered to the printing device 200 by the registration roller pair 130 being driven at a predetermined timing after a leading edge of the sheet P reaches the registration roller pair 130.

The printing device 200 includes a carrying drum 210 for carrying and conveying the sheet P on an outer peripheral surface of the carrying drum 210 and a liquid discharge unit 220 that discharges the liquid toward the sheet P carried on the carrying drum 210 to apply the liquid to the sheet P. The printing device 200 further includes a transfer cylinder 201 that receives the fed sheet P and transfers the sheet P to the carrying drum 210, and a delivery cylinder 202 that delivers the sheet P conveyed by the carrying drum 210 to the drying device 300.

The leading end of the sheet P conveyed from the loading device 100 to the printing device 200 is gripped by a sheet gripper 201*a* provided on a surface of the transfer cylinder 201 and is conveyed by the rotation of the transfer cylinder 201. The sheet P conveyed by the transfer cylinder 201 is delivered to the carrying drum 210 at a position facing the carrying drum 210.

A sheet gripper 210*a* is also provided on a surface of the carrying drum 210, and the leading end of the sheet P is gripped by the sheet gripper 210*a*. A plurality of dispersed suction holes is formed on the surface of the carrying drum 210, and a suction airflow directed toward the interior of the carrying drum 210 is generated in each of the suction holes by a suction device 211.

Then, the sheet P delivered from the transfer cylinder 201 to the carrying drum 210 is gripped by the sheet gripper 210*a* of the carrying drum 210, sucked by the suction airflow onto the surface of the carrying drum 210, and conveyed to the delivery cylinder 202 as the carrying drum 210 rotates.

The liquid discharge unit 220 discharges liquids (ink) of four colors of C (cyan), M (magenta), Y (yellow), and K (black) to print an image on the sheet P. The liquid discharge unit 220 includes liquid discharge heads 220C, 220M, 220Y, and 220K that applies individual liquids of each color on the sheet P. Note that the liquid discharge heads may discharge special liquids of colors such as white, gold, silver, and the like, and a liquid discharge heads may also discharge a process liquid such as a surface coating liquid as necessary. The liquid discharge unit 220 serves as a liquid application device to apply liquid to the sheet P.

A discharge operation of the liquid discharge heads 220C, 220M, 220Y, and 220K of the liquid discharge unit 220 is controlled by drive signals corresponding to print information. When the sheet P carried by the carrying drum 210 passes through a region facing the liquid discharge unit 220, the liquid of each color is discharged from the liquid discharge heads 220C, 220M, 220Y, and 220K, and an image corresponding to the printing information is printed on the sheet P.

The drying device 300 is a drying apparatus that includes a suction conveyance belt 301 to suck and convey the sheet P conveyed from the printing device 200 and a hot air blower 302 to blow hot air onto the sheet P conveyed by the suction conveyance belt 301 to dry the liquid on the sheet P, for example. The suction conveyance belt 301 is wound, for example, between the drive roller 303 and the driven roller 304 and is rotated by driving the drive roller 303.

The sheet P conveyed from the printing device 200 is received by the suction conveyance belt 301, conveyed to pass through the hot air blower 302, and delivered to the sheet correcting apparatus 600. The sheet P is further delivered from the sheet correcting apparatus 600 to the ejection device 400.

When the sheet P passes through the hot air blower 302, the liquid on the sheet P is subjected to a drying processing. As a result, the liquid component such as moisture in the liquid evaporates, and the colorant contained in the liquid is fixed on the sheet P.

When the dried sheet P passes through the sheet correcting apparatus 600, deformation such as cockling of the sheet P is corrected.

The ejection device 400 includes an ejection tray 410 on which a plurality of sheets P is stacked. The sheets P conveyed from the sheet correcting apparatus 600 are sequentially stacked and held on the ejection tray 410.

The printer 1 may include a pre-processing unit to perform pre-processing of image formation on the sheet P. The pre-processing unit is disposed on an upstream side of the printing device 200. Further, the printer 1 may include a post-processing unit to perform post-processing of image formation on the sheet P on which the liquid is adhered. The post-processing unit may be disposed between the sheet correcting apparatus 600 and the ejection device 400.

As the pre-processing unit, for example, there is a unit to perform a pre-application process of applying a treatment liquid on the sheet P before the image formation. The treatment liquid reacts with ink to reduce bleeding of the ink onto the sheet P. However, the content of the pre-processing is not particularly limited to the process as described above. Further, as the post-processing unit may perform a sheet reversing process and a binding process for binding a plurality of sheets P, for example. The sheet reversing process reverses the sheet P, on which image is printed by the printing device 200, and conveys the reversed sheet P again to the printing device 200 to print on both sides of the sheet P.

The "printer" in the present embodiment is not limited to an ink jet recording apparatus, and the printer may include a liquid discharge head for discharge liquid towards the sheet P. The "printer" is not limited to an apparatus to discharge liquid to render visible meaningful images, such as letters or figures. Thus, for example, the "printer" may include an apparatus to form arbitrary images, such as patterns, or fabricate three-dimensional images.

Further, the term "liquid" includes any liquid having a viscosity or a surface tension that can be discharged from the head. However, preferably, the viscosity of the liquid is not greater than 30 mPa·s under ordinary temperature and ordinary pressure or by heating or cooling. More specifically, the "liquid" is, for example, solution, suspension, emulsion or the like that includes a solvent, such as water or an organic solvent, a colorant, such as a dye or a pigment, a functionalizing material, such as a polymerizable compound, a resin, or a surfactant, a biocompatible material, such as DNA, amino acid, protein, or calcium, edible materials, such as natural colorants, and the like. Such liquids can be used, for example, for inkjet inks, surface treatment liquids and the like.

In addition, "printer" includes a serial type apparatus for moving the liquid discharge head, and a line type apparatus not moving the liquid discharge head, and the like.

Further, the term "liquid discharge head" represents a functional component to discharge and jet liquid from discharge orifices (nozzles). As an energy generating source to discharge liquid, a discharge energy generator, for example, a piezoelectric actuator (lamination-type piezoelectric element and thin-film piezoelectric element), a thermal actuator using an electrothermal transducer element, such as a heating resistor (element), or an electrostatic actuator including a diaphragm plate and opposed electrodes can be used. However, the energy generating source is not limited to any specific type and may be any other suitable discharge energy generator.

Figure 2:
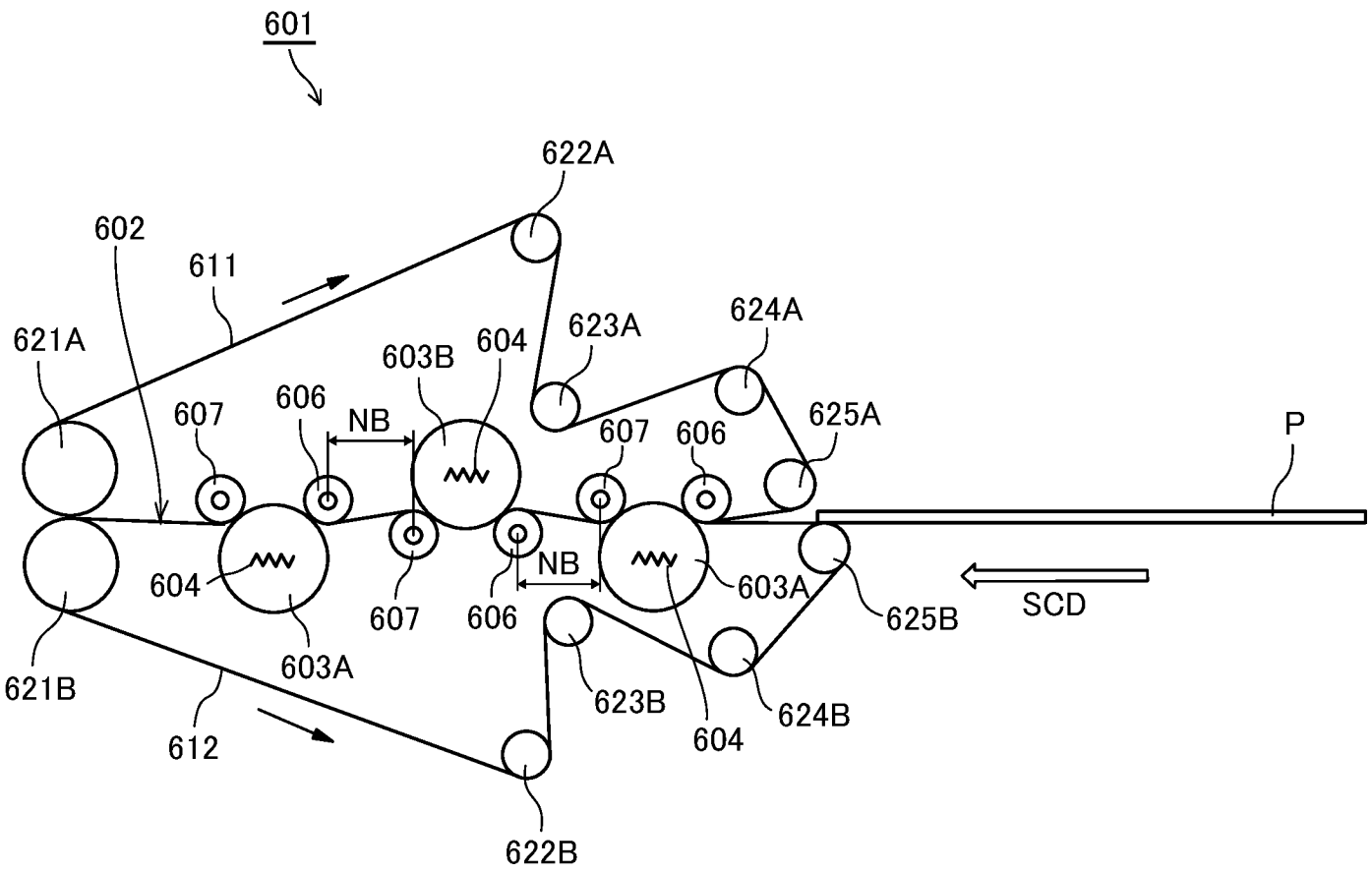
FIG. 2 is a side view of a sheet correcting device according to the first embodiment of the present disclosure.
Figure 3:
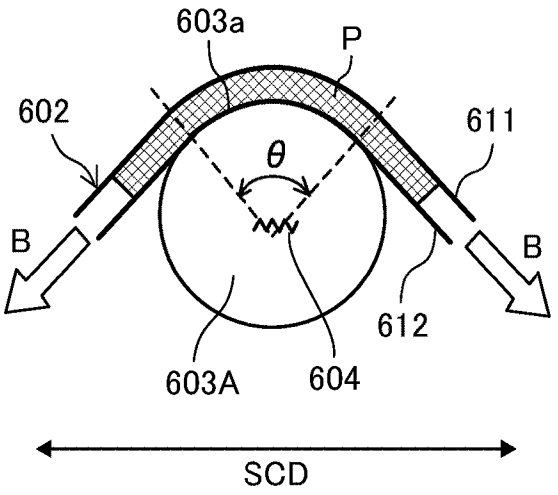
FIG. 3 is an enlarged cross-sectional view of a roller of the sheet correcting device according to the first embodiment.

Next, a sheet correcting device 601 that constitutes a sheet correcting apparatus 600 according to the first embodiment is described with reference to FIGS. 2 and 3. FIG. 2 is a side view of a sheet correcting device 601. The sheet correcting device 601 constitutes the sheet correcting apparatus 600. FIG. 3 is an enlarged cross-sectional view of a roller section.

The sheet correcting device 601 includes a belt pair 602 including an endless upper belt (first belt) 611 and a lower belt (second belt) 612 that convey the sheet P by sandwiching the sheet P between the upper belt 611 and the lower belt 612.

The upper belt 611 is wound around a conveyance roller 621A, a steering control roller 622A, and driven rollers 624A and 625A, and is tensioned by a tension roller 623A.

The lower belt 612 is wound around a conveyance roller 621B, a steering control roller 622B, and driven rollers 624B and 625B, and is tensioned by a tension roller 623B.

The upper belt 611 and the lower belt 612 circulate in directions indicated by arrows in FIG. 2 by rotation of the conveyance rollers 621A and 621B, so that the sheet P is sandwiched and held by the upper belt 611 and the lower belt 612 and is conveyed in a "sheet conveyance direction" indicated by arrow "SCD".

Here, the tension rollers 623A and 623B serve as tensioners, and each of the tension rollers 623A and 623B applies a tensile force to one of the upper belt 611 and the lower belt 612. The tensile force acts in a direction in which the belt surface of the belt pair 602 holding the sheet P is simultaneously pulled toward both the upstream side and the downstream side of the sheet in the conveyance direction Y.

The sheet correcting device 601 includes a plurality (three in FIG. 2) of rollers 603A and 603B disposed along the sheet conveyance direction SCD of the sheet P. The plurality of rollers 603A and 603B is disposed in an area in which belt surfaces of the upper belt 611 and the lower belt 612 of the belt pair 602 face each other and sandwich (nip) the sheet P. The plurality of rollers 603A and 603B contacts the upper belt 611 or the lower belt 612 of the belt pair 602. The rollers 603A and 603B deform a part of the belt pair 602 into a curved shape.

Each of the rollers 603A and 603B includes a heater 604 serving as a heat generator inside each of the rollers 603A and 603B. The rollers 603A and 603B are heating rollers that also serve as heating members for heating a region of the sheet P in which the sheet P is pressed against the rollers 603A and 603B via the belt pair 602 and is deformed (bent) in the curved shape.

Here, the rollers 603A and the roller 603B are alternately arranged in an area in which the belt surfaces of the upper belt 611 and the lower belt 612 face each other.

The belt pair 602 is bent such that the belt pair 602 is convex upward by a peripheral surface 603*a* (see FIG. 3) of each of the rollers 603A (first curved surface member) that press the lower belt 612 side of the belt pair 602 upward. The belt pair 602 is bent to have a convex shape deformed downward by the peripheral surface 603*a* of the roller 603B (second curved surface member) that presses the upper belt 611 side of the belt pair 602 downward.

Thus, the rollers 603A (first curved surface member) that bends one surface of the sheet P to be convex upward and the roller 603B (second curved surface member) that bends another surface of the sheet P to be convex downward are alternately arranged in the sheet conveyance direction SCD of the sheet P. Note that the rollers 603A and 603B may be alternately arranged such that the roller 603B is arranged at the most upstream in the sheet conveyance direction SCD.

The sheet correcting device 601 further includes first pressing members 606 and second pressing members 607. Specifically, the sheet correcting device 601 includes a plurality of sets of pressing members 606 and 607. Each of the plurality of sets of pressing members 606 and 607 includes the first pressing member 606 and the second pressing member 607.

A set of the first pressing member 606 and the second pressing member 607 constitute a pressing unit facing the peripheral surface 603*a* (curved surface) of each of the rollers 603A and 603B and press the belt pair 602 against the peripheral surface 603*a* of each of the rollers 603A and 603B. The first pressing members 606 and the second pressing members 607 are arranged along the sheet conveyance direction SCD. Here, each of the first pressing members 606 is arranged on the upstream side of each of the rollers 603A and 603B in the sheet conveyance direction SCD, and each of the second pressing members 607 is arranged on the downstream side of each of the rollers 603A and 603B in the sheet conveyance direction SCD.

Thus, the sheet correcting device includes the first pressing member 606 to press the belt pair 602 against the curved surface and the second pressing member 607 disposed downstream of the first pressing member 606 in the sheet conveyance direction SCD to press the belt pair 602 against the curved surface 603*a* facing the first pressing member 606. The first pressing member 606 is spaced away from the second pressing member 607 that faces the same curved surface 603*a* with the first pressing member 606.

The first pressing member 606 defines a pressing start position (winding start position) at which the belt pair 602 starts contacting the peripheral surface 603*a* of the rollers 603A and 603B. The second pressing member 607 defines a pressing end position (winding end position) at which the belt pair 602 separates from the peripheral surface 603*a* of each of the rollers 603A and 603B. The second pressing member 607 is disposed upstream of the first pressing member 606.

The second pressing member 607 facing the upstream side of the roller 603A or 603B is spaced away from the first pressing member 606 facing the downstream side of the roller 603A or 603B in a region between adjacent ones of the rollers 603A and 603B (curved surface members) in the sheet conveyance direction SCD. The upstream side roller 603 (one of the rollers 603A and 603B disposed on an upstream side) and the downstream side roller 603 (one of the rollers 603A and 603B disposed downstream of the upstream side roller 603) are arranged at an interval at which the belt pair 602 is not bent (held straight) between the second pressing member 607 disposed on the upstream side and the first pressing member 606 disposed downstream of the second pressing member 607. Here, the roller 603 described above includes the rollers 603A and 603B. In other words, the belt pair 602 is held substantially straight between the second pressing member 607 disposed on the upstream side and the first pressing member 606 disposed adjacent to and downstream of the first pressing member 606. Thus, the belt pair 602 is held substantially straight between the rollers 603A and 603B. A region in which the belt pair 602 is not bent between the second pressing member 607 disposed on the upstream side and the first pressing member 606 disposed downstream of the second pressing member 607 is indicated by arrow NB in FIG. 2.

Thus, the sheet correcting device 601 can release stress of the belt pair 602, which is once bent along the peripheral surface 603*a* of the rollers 603A and 603B. Thus, the sheet correcting device 601 can improve adhesion of the belt pair 602 to the rollers 603A and 603B of a next-stage.

The first pressing member 606 and the second pressing member 607 are disposed to be movable toward and away from the peripheral surface 603*a* of the roller 603A or 603B. As a result, a winding angle θ of the belt pair 602 on the peripheral surface 603*a* of the roller 603A or 603B can be changed according to a thickness (type) of the sheet P and an amount of the liquid applied to the sheet P, and the like.

Figure 4:
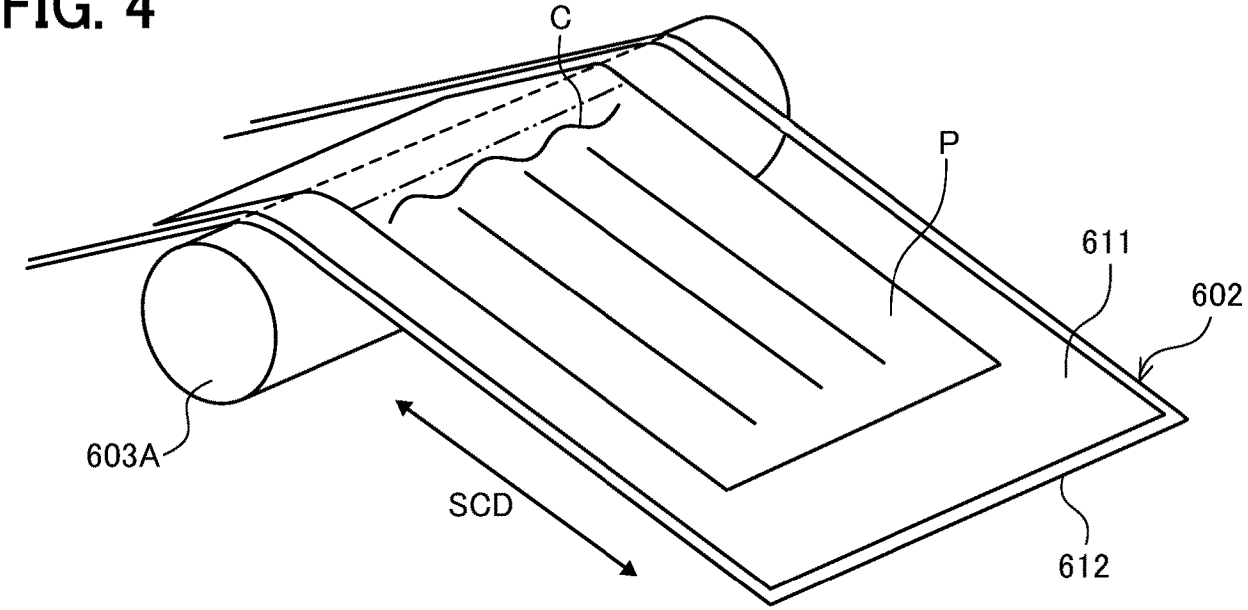
FIG. 4 is a perspective view of the roller of the sheet correcting device according to the first embodiment.

Next, the operation of the present embodiment is described with reference to FIG. 4. FIG. 4 is a perspective view of the roller 603A and the belt pair 602 in a state in which the sheet P sandwiched between the upper belt 611 and the lower belt 612 of the belt pair 602 is seen through the belt pair 602.

As illustrated in FIG. 4, when cockling (waving) C remains on the sheet P, the cockling (waving) disappears while the sheet P is wound around a curved surface such as the peripheral surface 603*a* of the roller 603 with applying tension on the sheet P. The cockling (waving) disappears because both of a portion of the sheet P on which the liquid is applied and swollen and a portion of the sheet P on which the liquid is not applied are tensioned and heated equally.

However, the cockling (waving) arises again and is not corrected when the tension is lost (not applied) if the sheet P is merely wound around the curved surface (peripheral surface 603*a*) of the roller 603 while applying tension to the sheet P without heating the sheet P.

The sheet correcting device 601 heats the sheet P with the heating members (the rollers 603A and 603B) and squeezes the sheet P while evaporating the moisture in the sheet P. Thus, the sheet correcting device 601 can apply the tension and the heat equally to the portion of the sheet P on which the liquid is applied and the portion of the sheet P on which the liquid is not applied. Thus, the sheet correcting device can correct the cockling (waving) of the sheet P.

That is, as illustrated in FIG. 3, the sheet P is sandwiched and held between two belts of the upper belt 611 and the lower belt 612 and is pressed against the peripheral surface 603*a* of the roller 603 serving as a heating roller in this sandwiched state. Thus, the belt pair 602 is deformed into a curved shape (bent upward) while holding the sheet P between the upper belt 611 and the lower belt 612.

At this time, the upper belt 611 and the lower belt 612 are tensioned by the tension rollers 623A and 623B so that a force is applied to the upper belt 611 and the lower belt 612 in a direction indicated by arrows "B" in FIG. 3, that is, a direction in which the upper belt 611 and the lower belt 612 are pressed against the peripheral surface 603*a* of the roller 603A serving as the heating roller.

Further, the sheet P sandwiched between the upper belt 611 and the lower belt 612 is pressed against the peripheral surface 603*a* (curved surface) of the roller 603A as the heating roller while the tension is applied to the sheet P in the direction indicated by arrow B by friction between the sheet P and the upper belt 611 and the lower belt 612.

Thus, the sheet correcting device 601 can apply heat and tension equally on the portion of the sheet P on which the liquid is applied and the portion of the sheet P on which the liquid is not applied by heating the sheet P with the rollers 603A and 603B while pressing the sheet P against the peripheral surface 603*a* of the rollers 603A and 603B. The sheet P is deformed by the rollers 603A and 603B so that deformed shape of the sheet P follows a curve of the peripheral surface 603*a* of the rollers 603A and 603B. Thus, the sheet correcting device 601 can correct the deformation such as cockling (waving) of the sheet P.

In this manner, the sheet correcting device 601 can efficiently correct the deformation of the sheet P by pressing the sheet P against curved surface members (rollers 603A and 603B in the present embodiment) while applying tension to the sheet P to bent and deform the sheet P in a curved shape while heating the sheet P.

In the present embodiment, as illustrated in FIG. 2, the rollers 603A and 603B are disposed along the sheet conveyance direction SCD to contact a region in which the upper belt 611 and the lower belt 612 faces (region of the belt pair 602 sandwiching the sheet P). The rollers 603A and 603B are the heating rollers serving as a plurality of curved surface members.

As described above, the sheet P is heated by the heating members (rollers 603A and 603B) to evaporate the moisture in the sheet P while the sheet P is squeezed. Thus, the sheet correcting device 601 can apply the tension and the heat equally on the portion of the sheet P on which the liquid is applied and the portion of the sheet P on which the liquid is not applied. Thus, the sheet correcting device 601 can correct the deformation such as cockling (waving) of the sheet P.

In this case, an effect of correction of the cockling (waving) of the sheet P is further increased by winding the sheet P around a plurality of curved surface members (rollers 603A and 603B) at small winding angles for a plurality of times rather than winding the sheet P around a circumferential surface of one curved surface member (roller) with a large winding angle.

For example, an effect of correction of the cockling (waving) of the sheet P when the sheet P is wound around a roller having a diameter φ of 80 mm with a winding angle θ of 30 degrees for three times is larger than the effect of correction when the sheet P is wound around a roller having a diameter φ of 80 mm at a winding angle θ of 90 degrees for one time.

In the present embodiment, the roller 603A that bends the belt pair 602 to be convex upward and the roller 603B that bends the belt pair 602 to be convex downward are alternately arranged.

Thus, both surfaces of the sheet P are pressed against the rollers 603A and 603B so that the sheet P is alternately protrude upward and downward. Thus, the sheet correcting device 601 can reliably correct the deformation (cockling) of the sheet P while suppressing an occurrence of curling.

Figure 5:
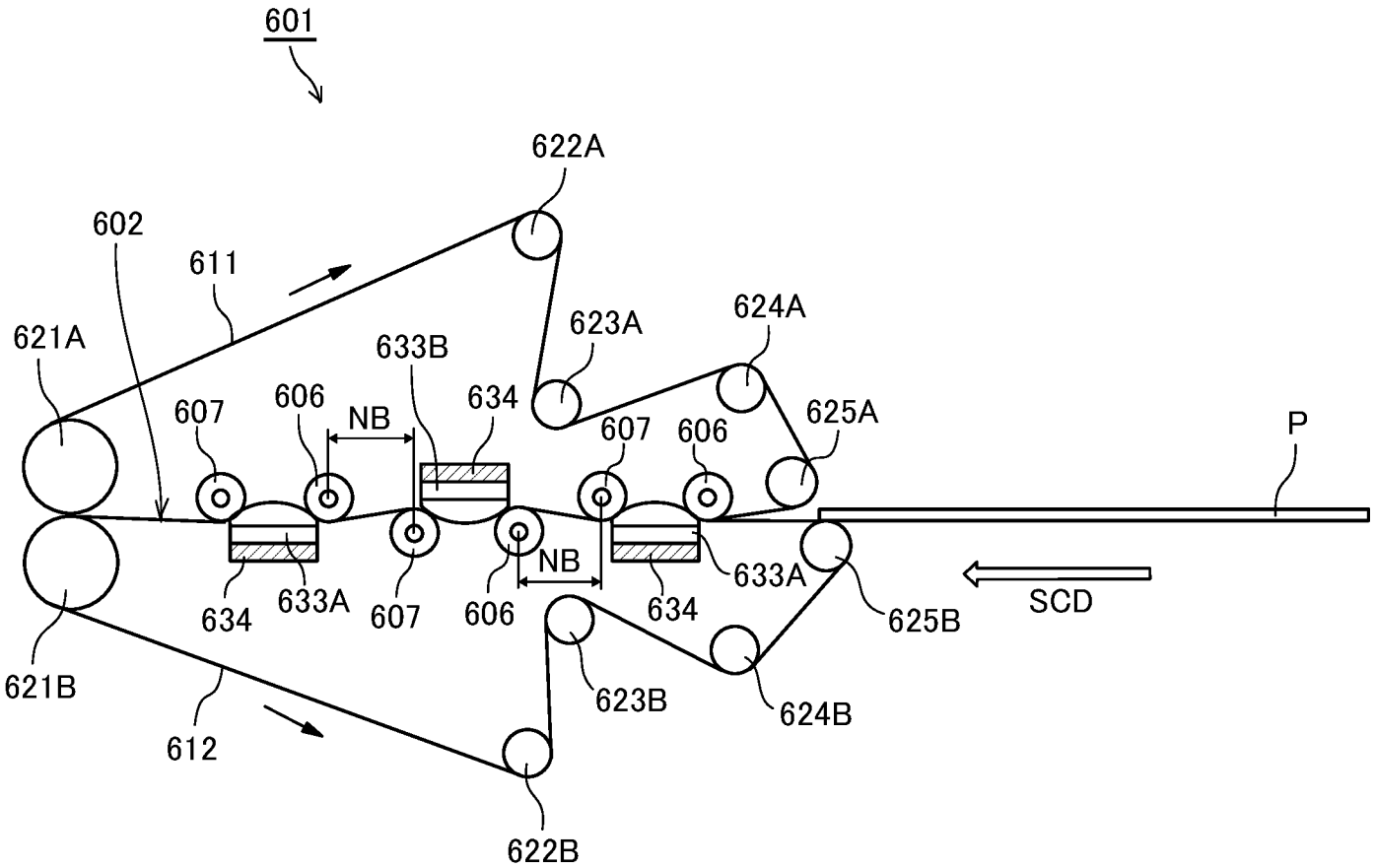
FIG. 5 is a side view of a sheet correcting device according to a second embodiment of the present disclosure.
Figure 6:
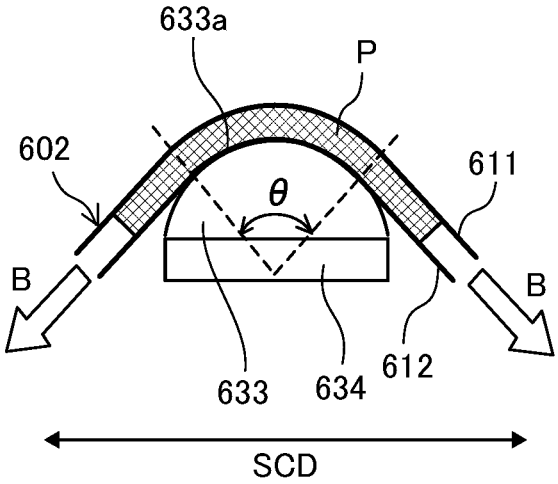
FIG. 6 is an enlarged cross-sectional view of a roller of the sheet correcting device according to the second embodiment.

Next, a sheet correcting device 601 according to a second embodiment of the present disclosure is described with reference to FIGS. 5 and 6. FIG. 5 is a side view of the sheet correcting device. FIG. 6 is an enlarged cross-sectional view of a curved surface member.

In the present embodiment, a plurality of curved surface members 633 (633A and 633B) has a substantially semicircular cross-section and includes a curved surface 633*a* (see FIG. 6) contacting the upper belt 611 and the lower belt 612 of the belt pair 602 where the belt pair 602 sandwiches and holds the sheet P. The plurality of curved surface members 633 includes a heater portion 634 as a heat generator serving as a heating member for heating the sheet P.

Also in the present embodiment, the curved surface member 633A contacting the lower belt 612 and the curved surface member 633B contacting the upper belt 611 are alternately arranged where the respective belt surfaces of the upper belt 611 and the lower belt 612 of the belt pair 602 face each other and sandwich the sheet P to hold the sheet P.

The belt pair 602 is bent and deformed in a direction convex upward by the curved surface 633*a* of the curved surface member 633A that pushes the lower belt 612 of the belt pair 602 upward. The belt pair 602 is bent and deformed in a direction convex downward by the curved surface 633*a* of the curved surface member 633B that pushes the upper belt 611 of the belt pair 602 downward.

In other words, the curved surface member 633A that bends one side of the sheet P to be convex upward and the curved surface member 633B that bends another side of the sheet P to be convex downward are arranged alternately. Note that the curved surface members 633A and 633B may be alternately arranged while arranging the curved surface member 633B at the most upstream side (right end side in FIG. 5).

Also, in the present embodiment, the first pressing member 606 and the second pressing member 607 constituting the pressing unit are disposed along the sheet conveyance direction SCD.

The first pressing member 606 determines a pressing start position (winding start position) at which the belt pair 602 starts contacting the curved surface 633*a* of the curved surface members 633A and 633B. The second pressing member 607 determines a pressing end position (winding end position) where the belt pair 602 separates from the curved surface 633*a* of the curved surface members 633A and 633B.

The second pressing members 607 facing the upstream side of the curved surface members 633A or 633B is separated from the first pressing members 606 facing the downstream side of the curved surface members 633A and 633B in a region of each curved surface members 633A and 633B adjacent in the sheet conveyance direction SCD. For example, the second pressing member 607 facing the most upstream side (right end in FIG. 5) of the curved surface member 633A is spaced away from the first pressing member 606 facing the downstream side (center in FIG. 5) of the curved surface member 633B in the sheet conveyance direction SCD.

Further, the second pressing member 607 facing the upstream side (center in FIG. 5) of the curved surface member 633B is spaced away from the first pressing member 606 facing the downstream side (left end in FIG. 5) of the curved surface member 633A in the sheet conveyance direction SCD. Further, the curved surface member 633A and the curved surface member 633B are disposed at an interval in which the belt pair 602 does not bend (held straight) between the second pressing member 607 disposed upstream side and the first pressing member 606 disposed downstream of the second pressing member 607. A region in which the belt pair 602 is not bent between the second pressing member 607 disposed upstream side and the first pressing member 606 disposed downstream side of the second pressing member is indicated by NB in FIG. 5.

Thus, the sheet correcting device 601 can release stress of the belt pair 602, which is once bent along the curved surface 633*a* of the curved surface members 633A and 633B. Thus, the sheet correcting device 601 can improve adhesion of the belt pair 602 to the curved surface members 633A and 633B of a next-stage.

Further, the first pressing member 606 and the second pressing member 607 similar to the first pressing member 606 and the second pressing member 607 in the first embodiment are arranged to be movable to face the curved surface members 633A and 633B.

In the present embodiment as well, as illustrated in FIG. 6, the sheet P sandwiched between the upper belt 611 and the lower belt 612 is pressed against the curved surface 633*a* of the curved surface member 633 serving as the heating member while the tension is applied to the sheet P in the direction indicated by arrow B by friction between the sheet P and the upper belt 611 and the lower belt 612.

As a result, the sheet P is heated by the curved surface member 633 and follows the curved surface 633*a* of the curved surface member 633, and the deformation of the sheet P such as cockling is thus corrected. Thus, the sheet correcting device 601 can apply the tension and the heat equally on the portion of the sheet P on which the liquid is applied and the portion of the sheet P on which the liquid is not applied. Thus, the sheet correcting device 601 can correct the deformation such as cockling (waving) of the sheet P.

Figure 7:
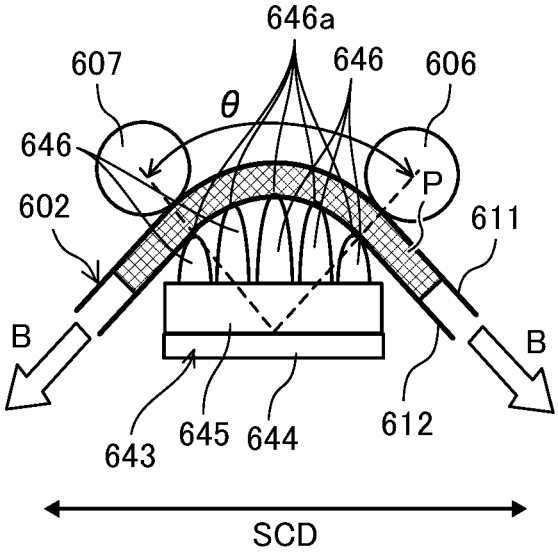
FIG. 7 is an enlarged cross-sectional view of a roller of the sheet correcting device according to a third embodiment.

Next, a sheet correcting device according to a third embodiment of the present disclosure is described with reference to FIG. 7. FIG. 7 is a cross-sectional view of the curved surface member of the sheet correcting device.

In the present embodiment, the curved surface member 643 includes a plurality of contact members 646 arranged in the sheet conveyance direction SCD of the sheet P. Each of the plurality of contact members 646 includes curved surface on a leading end of the plurality of contact members 646. A curved surface is formed by virtually connecting apexes of each of the plurality of contact members 646.

The plurality of contact members 646 is held on a base 645. The height of the plurality of contact members 646 from the base 645 is such that a leading end 646*a* of one of the contact members 646 disposed in a center in the sheet conveyance direction SCD protrudes beyond leading ends 646*a* of the contact members 646 disposed at lateral ends in the sheet conveyance direction SCD.

There are five contact members 646 illustrated in FIG. 5. The height of the plurality of contact members 646 decreases toward the upstream end (right end in FIG. 7) in the sheet conveyance direction SCD when the contact member 646 at a center position is a start position. Similarly, the height of the plurality of contact members 646 decreases toward the downstream end (left end in FIG. 7) in the sheet conveyance direction SCD when the contact member 646 at the center position is the start position. Thus, the height of the contact member 646 at the center position is the highest among the height of the plurality of contact members 646.

The curved surface member 643 includes a heater as the heat generator 644 on the base 645 side, for example. The curved surface member 643 may include a heater built inside the contact members 646 also serving as heating members for heating the sheet P.

In this embodiment as well, as illustrated in FIG. 7, the sheet P sandwiched between the upper belt 611 and the lower belt 612 is tensioned in the direction B by friction between the upper belt 611 and the lower belt 612 and the sheet P. In this tensioned state, the sheet P is pressed against a plurality of contact members 646. The plurality of contact members 646 (five in FIG. 7) forms a curved shape as a whole to form the curved surface member 643 that serves as a heating member.

Thus, the sheet P is heated by the curved surface member 643 and follows the curved shape constituted by the plurality of contact members 646. Thus, the sheet correcting device 601 can correct the deformation such as cackling (waving) of the sheet P.

Similarly to the first and second embodiments, the sheet correcting device 601 can further improve an effect of correcting the cackling of the sheet P by arranging the plurality contact members 646 along the sheet conveyance direction SCD that forms the curved surface member 643.

For example, a rotating member may be rotatably provided on a leading end 646*a* of the plurality of contact members 646. The rotating member can reduce frictional resistance between each of the plurality of contact members 646 and the belt pair 602 so that the belt pair 602 can smoothly move while the belt pair 602 is in a curved state.

Figure 8:
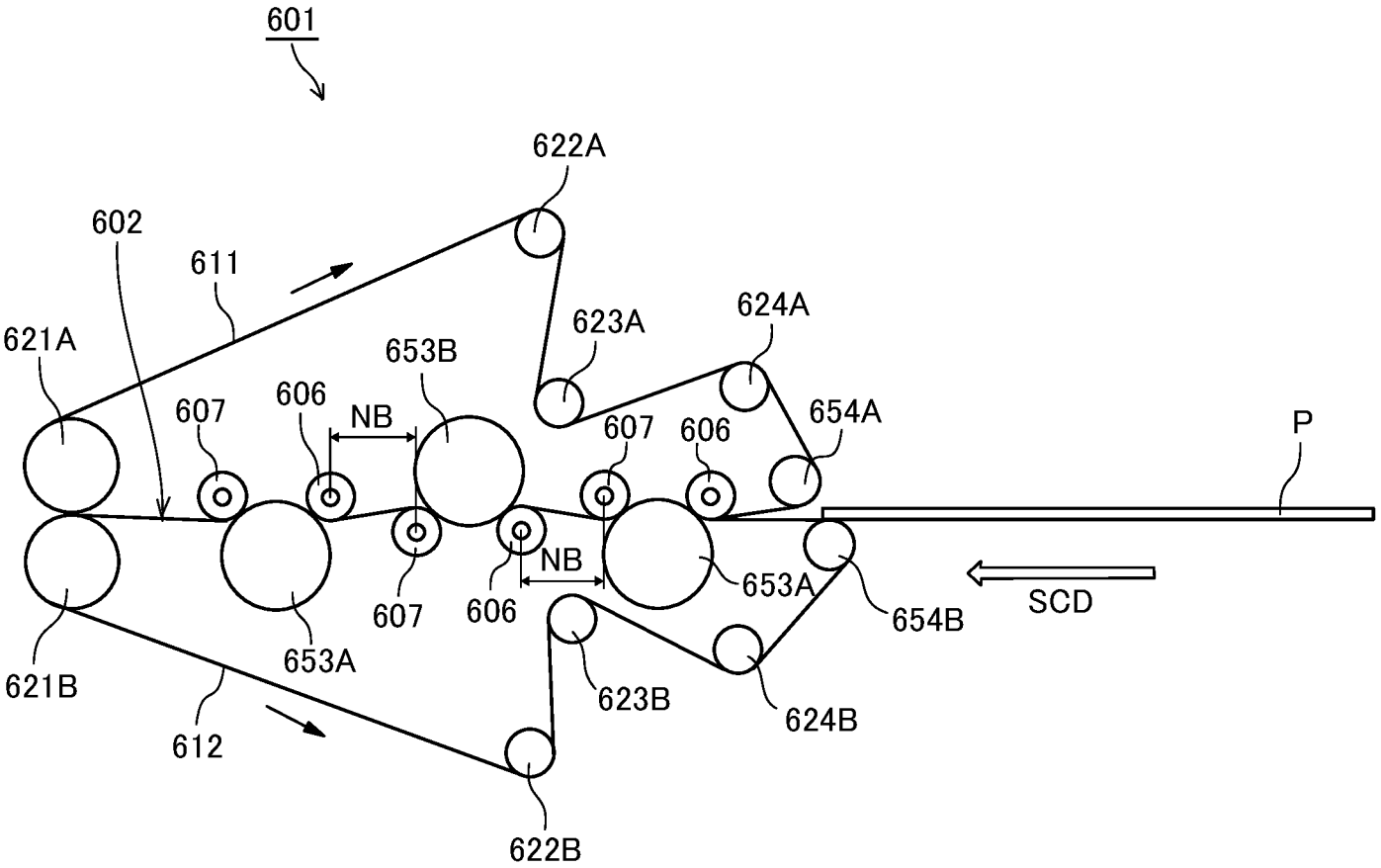
FIG. 8 is a side view of a sheet correcting device according to a fourth embodiment of the present disclosure.

Next, a sheet correcting device 601 according to a fourth embodiment of the present disclosure is described with reference to FIG. 8. FIG. 8 is a side view of the sheet correcting device 601.

In the present embodiment, the sheet correcting device 601 includes heating rollers 654A and 654B disposed at an upstream of a position at which the sheet P is sandwiched between the upper belt 611 and the lower belt 612 instead of the driven rollers 625A and 625B in the first embodiment.

The sheet correcting device 601 includes, as curved surface members, rollers 653 (653A and 653B) that do not include heating members.

Thus, the sheet correcting device 601 according to the present embodiment heats the upper belt 611 and the lower belt 612 by the heating rollers 654A and 654B, respectively while the upper belt 611 and the lower belt 612 sandwiches the sheet P. As a result, the sheet P is heated by the upper belt 611 and the lower belt 612 and is pressed against the roller 603 via the belt pair 602.

That is, when the sheet P is pressed against the rollers 653A and 653B for correction, it is unnecessary to directly heat a portion at which the belt pair 602 is bent by the rollers 653A and 653B as in the first embodiment if a temperature of the sheet P is maintained high by the heating rollers 654A and 654B. Thus, in the present embodiment, the belt pair 602 is heated upstream of a position at which the upper belt 611 and the lower belt 612 sandwiches the sheet P in the sheet conveyance direction SCD by the heated belt pair 602.

Thus, the present embodiment can improve a correcting function without increasing the number of the heating member while increasing the number of the curved surface members (correcting portions). Further, it is unnecessary to move a cable of the heating member (for example, heaters) together when correcting a thick paper.

Figure 9A:
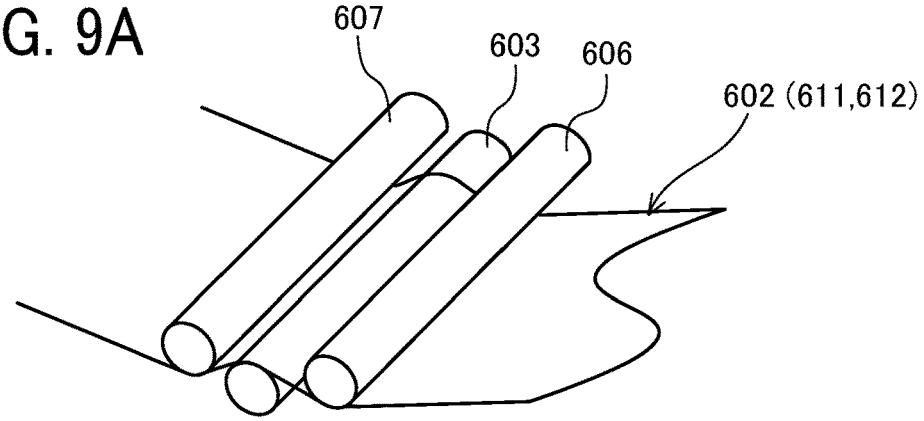
FIGS. 9A through 9C are perspective views of a portion of a curved surface member and a belt pair.
Figure 9B:
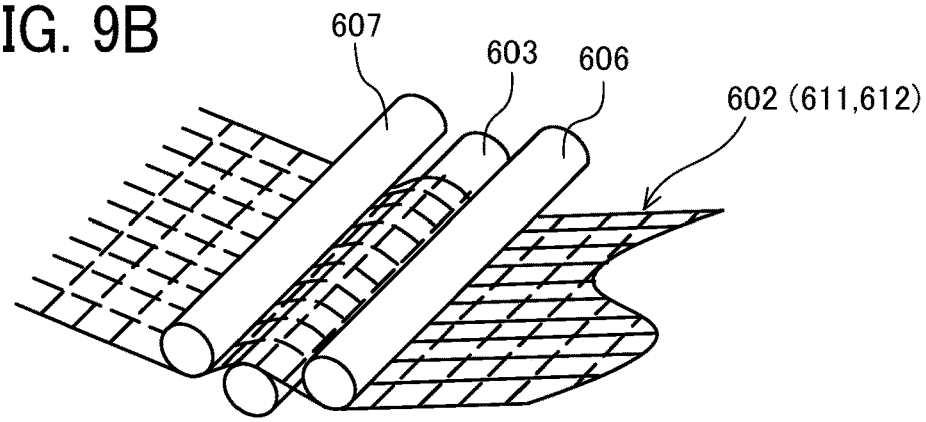
Figure 9C:
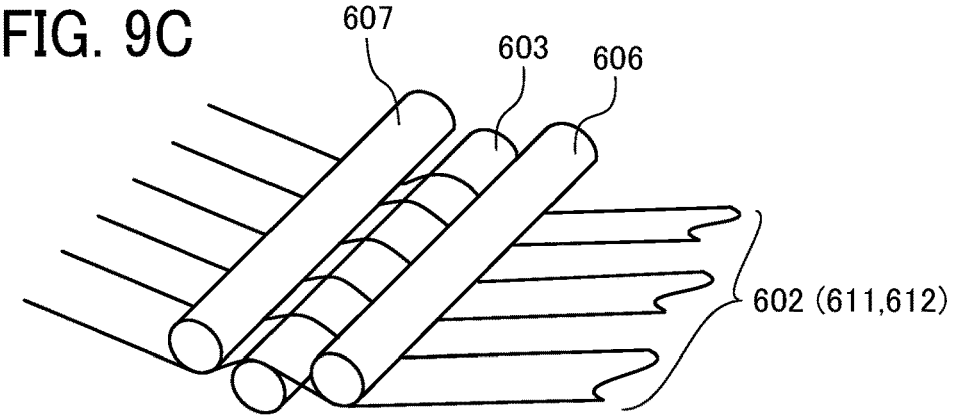

FIGS. 9A through 9C illustrate belt pairs of different examples in the first to fourth embodiments. FIGS. 9A through 9C are perspective views of a portion of the curved surface member of the belt pair.

The upper belt 611 and the lower belt 612 that form the belt pair 602 as illustrated in FIG. 9A are full-surface belts that can cover an entire surface of the sheet P. The upper belt 611 and the lower belt 612 that form the belt pair 602 as illustrated in FIG. 9B are mesh belts such as wire mesh belts. The upper belt 611 and the lower belt 612 that form the belt pair 602 as illustrated in FIG. 9C are divided belts in which a belt is divided into multiple rows of belts in a direction perpendicular to the sheet conveyance direction SCD.

Any of the belts illustrated in FIGS. 9A through 9C may be used as the upper belt 611 and the lower belt 612 forming the belt pair 602.

When the upper belt 611 and the lower belt 612 that form the belt pair 602 are the mesh belts illustrated in FIG. 9B or the divided belts illustrated in FIG. 9C, the moisture in the sheet P is evaporated by heating the liquid attached to the sheet P. The evaporated moisture is escaped from gaps of the mesh of the mesh belt or is escaped from gaps formed between the divided belts. Thus, an effect of heating the sheet P in the mesh belt (see FIG. 9B) and the divided belt (see FIG. 9C) is increased compared to the full-surface belt (see FIG. 9A).

Figure 10:
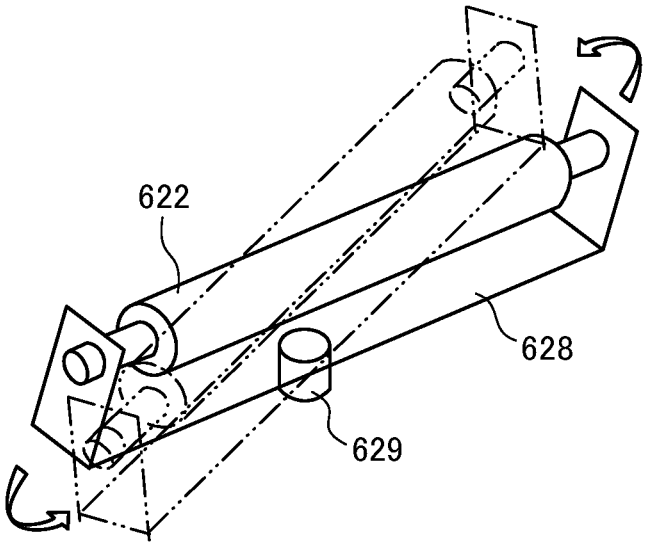
FIG. 10 is a perspective view of a steering control roller.

Next, steering control of the belt pair 602 is described with reference to FIG. 10. FIG. 10 is a perspective view of the steering control roller 622.

The steering control roller 622 is rotatably held by a bracket 628. The bracket 628 is rotatably held by the rotation shaft 629. The rotation shaft 629 holds a center (or end) of the bracket 628 in an axial direction of the steering control roller 622.

A direction of conveyance of the belt pair 602 is changed by detecting a position of the belt pair 602 and changing an angle of the steering control roller 622.

Figure 11:
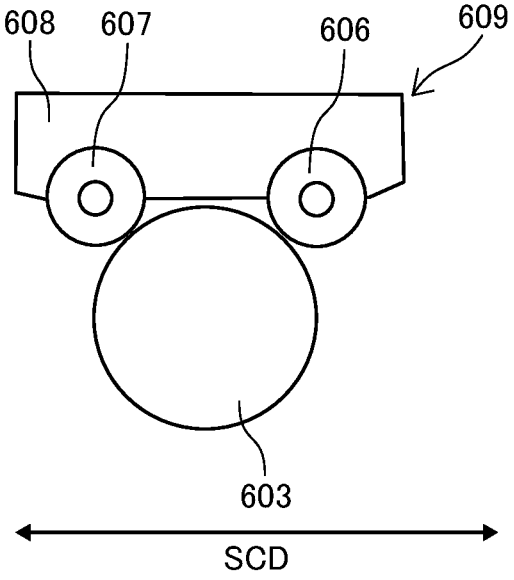
FIG. 11 is a cross-sectional view of a first pressing member and a second pressing member in a vicinity of the curved surface member.

FIG. 11 illustrate an integration of the first pressing member 606 and the second pressing member 607 in the first to fourth embodiments of the present disclosure. FIG. 11 is a cross-sectional view of the first pressing member 606 and the second pressing member 607 in a vicinity of the curved surface member (rollers 603).

The first pressing member 606 and the second pressing member 607 facing the roller 603 (or the curved surface member 633) serving as the curved surface member are rotatably held by the holder 608, for example, to form a pressing roller unit 609.

Integrating the first pressing member 606 and the second pressing member 607 as single unit enables the first pressing member 606 and the second pressing member 607 to advance toward and retract from the roller 603 (or the curved surface member 633). Thus, the present embodiment can simplify a structure of mechanism of advancing and retracting the first pressing member 606 and the second pressing member 607 toward and from the roller 603 (or the curved surface member 633).

Figure 12:
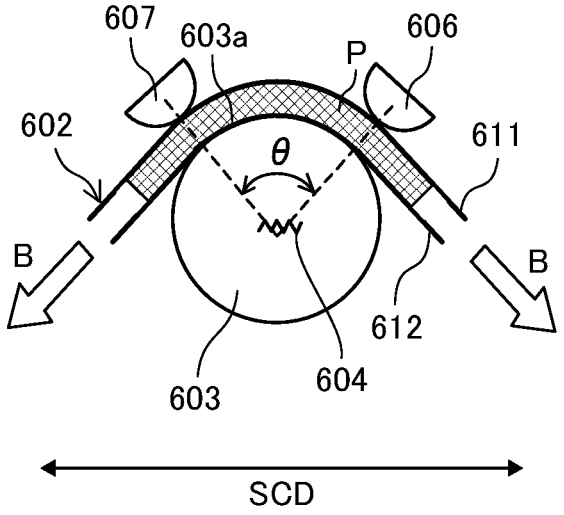
FIG. 12 is a cross-sectional view of a vicinity of the curved surface member in another embodiment.

Next, another example of the pressing member is described with reference to FIG. 12, which is a cross-sectional view of a vicinity of the curved surface member of the example.

Here, a first pressing member 606 and a second pressing member 607 have a semicircular cross section.

Thus, a shape of the first pressing member 606 and the second pressing member 607 is not limited to the roller. Either one of a shape of the first pressing member 606 and the second pressing member 607 may be formed in a roller and another of the shape of the first pressing member 606 and the second pressing member 607 may be formed in a semicircular.

In each of the above-described embodiments, the sheet correcting device has been described as an example in which the sheet is conveyed in a horizontal direction (lateral direction). Alternatively, the sheet P may be conveyed in a vertical direction or an oblique direction.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A sheet correcting device; comprising:

a belt pair including a first belt and a second belt to sandwich a sheet between the first belt and the second belt to convey the sheet in a sheet conveyance direction;

a plurality of curved surface members disposed along the sheet conveyance direction, each of the plurality of curved surface members comprising a curved surface to contact the belt pair in an area in which the belt pair sandwiches the sheet;

a plurality of sets of pressing members, each of the plurality of sets of pressing members facing the curved surface of only one of the plurality of curved surface members to press the belt pair against the curved surface of the one of the plurality of curved surface members, wherein each pressing member in each of the sets of pressing members presses the belt pair against only the one of the plurality of curved surface members; and a heater to heat the sheet via at least one of the first belt and the second belt of the belt pair, wherein each of the plurality of sets of pressing members includes:

a first pressing member to press the belt pair against the curved surface; and a second pressing member disposed downstream of the first pressing member in the sheet conveyance direction to press the belt pair against the curved surface facing the first pressing member, and wherein the first pressing member is spaced away from the second pressing member.

2. The sheet correcting device according to claim 1, further comprising a plurality of tensioners, wherein each of the plurality of tensioners applies a tensile force to one of the first belt and the second belt in a direction in which a belt surface of the one of the first belt and the second belt of the belt pair to hold the sheet is pulled toward both upstream and downstream of the sheet in the sheet conveyance direction.

3. The sheet correcting device according to claim 1, wherein each of the plurality of curved surface members is a roller.

4. The sheet correcting device of claim 3, wherein each of the first and second pressing members is a roller with a smaller radius than the curved surface members.

5. The sheet correcting device according to claim 1, wherein each of the plurality of curved surface members includes a plurality of contact members disposed along the sheet conveyance direction, and a leading end of one of the plurality of contact members disposed at a center in the sheet conveyance direction protrudes beyond leading ends of the plurality of contact members disposed at lateral ends in the sheet conveyance direction.

6. The sheet correcting device according to claim 1, wherein at least one of the first pressing member and the second pressing member is a roller.

7. The sheet correcting device according to claim 1, wherein at least one of the first pressing member and the second pressing member is movable toward and away from the curved surface of a corresponding one of the plurality of curved surface members.

8. The sheet correcting device according to claim 1, wherein the plurality of curved surface members comprises a first curved surface member that bends the belt pair to be convex upward and a second curved surface member that bends the belt pair to be convex downward, and the first curved surface member and the second curved surface member are disposed along the sheet conveyance direction.

9. The sheet correcting device according to claim 1, wherein a first one of the plurality of curved surface members and a second one of the plurality of curved surface members disposed adjacent to and downstream from the first one of the plurality of curved surface members in the sheet conveyance direction are arranged at an interval at which the belt pair is held straight between the first pressing member facing the second one of the plurality of curved surface members and the second pressing member disposed upstream of the first pressing member and facing the first one of the plurality of curved surface members.

10. The sheet correcting device according to claim 1, wherein the heater is disposed inside each of the plurality of curved surface members.

11. The sheet correcting device according to claim 10, wherein each of the plurality of curved surface members is a heating roller comprising the heater.

12. The sheet correcting device according to claim 1, wherein the heater is disposed upstream from the area in which the belt pair sandwiches the sheet to heat the belt pair.

13. The sheet correcting device according to claim 1, wherein the first belt and the second belt of the belt pair are mesh belts.

14. The sheet correcting device according to claim 1, wherein each of the first belt and the second belt of the belt pair is divided into multiple rows of belts in a direction perpendicular to the sheet conveyance direction.

15. A printer comprising:

a liquid application device to apply liquid to a sheet; and the sheet correcting device according to claim 1, wherein the sheet correcting device is disposed downstream of the liquid application device in the sheet conveyance direction.

16. The printer according to claim 15, further comprising a drying apparatus to dry the sheet, wherein the drying apparatus is disposed between the liquid application device and the sheet correcting device.

17. The printer according to claim 15, wherein the liquid application device discharges ink onto the sheet to form an image on the sheet.

18. The sheet correcting device of claim 1, wherein the heater is disposed in each of the plurality of curved surface members, but not in the pressing members.

19. A sheet correcting device, comprising:

a belt pair including a first belt and a second belt to sandwich a sheet between the first belt and the second belt to convey the sheet in a sheet conveyance direction;

a plurality of curved surface members disposed along the sheet conveyance direction, each of the plurality of curved surface members comprising a curved surface to contact the belt pair in an area in which the belt pair sandwiches the sheet;

a plurality of sets of pressing members, each of the plurality of sets of pressing members facing the curved surface of each of the plurality of curved surface members to press the belt pair against the curved surface of each of the plurality of curved surface members; and a heater to heal the sheet via at least one of the first belt and the second belt of the belt pair, wherein each of the plurality of sets of pressing members includes a first pressing member to press the belt pair against the curved surface; and a second pressing member disposed downstream of the first pressing member in the sheet conveyance direction to press the belt pair against the curved surface facing the first pressing member, the first pressing member is spaced away from the second pressing member, and each of the plurality of curved surface members includes a plurality of contact members disposed along the sheet conveyance direction.

* * * * *